US009080583B2

(12) United States Patent
Zajac, Jr. et al.

(10) Patent No.: US 9,080,583 B2
(45) Date of Patent: Jul. 14, 2015

(54) COMPACT LINEAR ACTUATOR WITH ANTI-ROTATION DEVICE

(75) Inventors: Theodore S. Zajac, Jr., Avon Lake, OH (US); Brian Frederick Iselin, Elyria, OH (US)

(73) Assignee: Zaytran, Inc., Elyria, OH (US)

( * ) Notice: Subject to any disclaimer, the term of this patent is extended or adjusted under 35 U.S.C. 154(b) by 556 days.

(21) Appl. No.: 13/447,411

(22) Filed: Apr. 16, 2012

(65) Prior Publication Data

US 2013/0269516 A1 Oct. 17, 2013

(51) Int. Cl.
*F16J 1/00* (2006.01)
*F15B 15/14* (2006.01)

(52) U.S. Cl.
CPC ..... *F15B 15/1419* (2013.01); *F15B 15/1414* (2013.01)

(58) Field of Classification Search
CPC .. F02F 3/022; F15B 15/1419; F15B 15/1414; F15B 15/24
USPC ..... 92/165 PR, 13.41, 18, 23, 59, 128, 13.4, 92/177
See application file for complete search history.

(56) References Cited

U.S. PATENT DOCUMENTS 3,180,236 A * 4/1965 Beckett ..... 92/164
5,974,948 A 11/1999 Thompson et al.
6,931,982 B1 * 8/2005 Zajac et al. ..... 92/5 R

OTHER PUBLICATIONS

U.S. Appl. No. 13/869,361, filed Apr. 24, 2013.

* cited by examiner

*Primary Examiner* — Edward Look
*Assistant Examiner* — Jason Mikus
(74) *Attorney, Agent, or Firm* — Eschweiler & Associates, LLC

(57) ABSTRACT

A linear actuator is provided having a housing with a bore having at least first and second portions extending therethrough. The second portion has a polygonal geometry with substantially rounded corners having at least one planar bearing surface. A shaft is in sliding engagement with the first portion of the bore, and a piston member is operatively coupled to the shaft. The piston member has a mating geometry to the second portion of the bore, wherein the piston member is in sliding engagement with the second portion of the bore. An anti-rotation member is coupled to the piston member or shaft and has a generally D-shaped geometry with a planar anti-rotation bearing surface. Contact between the anti-rotation member and the housing is limited to a sliding engagement between the anti-rotation bearing surface and one of the at least one bearing surfaces based on an orientation of the anti-rotation member.

23 Claims, 7 Drawing Sheets

COMPACT LINEAR ACTUATOR WITH ANTI-ROTATION DEVICE

FIELD

The present invention relates generally to linear actuators, and more particularly to a robust and compact linear actuator having a configurable anti-rotation device.

BACKGROUND

Industrial linear actuators perform a variety of functions, such as linearly translating a locating pin, or operating a clamp for maintaining a position of a workpiece. A typical linear actuator comprises a housing having a linearly-translating shaft that is operably coupled to a drive means, such as a pneumatic piston and cylinder arrangement, or a geared electric motor. In many applications, precise positioning of the linearly-translating shaft is essential to maintaining specific tolerances in a final assembly of the workpiece.

It is often desirable that the shaft of the linear actuator not rotate with respect to the housing, but rather, extend in a straight line along a single axis without rotation about the axis. Thus, it is desirable that the yaw, pitch, and roll of the shaft with respect to the linear translation be minimized. Accordingly, attempts have been made to accurately position the shaft with respect to the housing, wherein various mechanisms and shaft designs have been used to prevent such yaw, pitch, and roll. One common example is illustrated in FIG. 1, wherein a conventional linear actuator 10 is provided having a square shaft 15 that extends and retracts with respect to a housing 20 for positioning a workpiece (not shown). The housing 20, is provided with a square bore 25, wherein the square bore, in conjunction with a sacrificial square bearing 30, guides the shaft 15 throughout its extension and retraction. The sacrificial square bearing 30 is typically comprised of a material that is substantially softer than the square shaft 15, thus allowing the square bearing to wear more quickly than the typically more-expensive square shaft.

The implementation of a sacrificial square bearing 30, however, typically requires the sacrificial square bearing to be replaced on a regular basis, thus leading to increased maintenance costs. Further, while the square shaft 15 and square bore 25 may last significantly longer without requiring replacement than the sacrificial square bearing 30, tight dimensional tolerances of the bearing surfaces 35 of square shaft 15, square bore 25, and square bearing 30 are still typically maintained for accurate operation of the linear actuator. Accordingly, dimensions of twelve or more bearing surfaces that are present between the square shaft 15 and the square bore 25 and square bearing 30 are typically held tightly during the manufacture of the linear actuator 10.

If manufacturing tolerances are not tightly held between the square shaft 15, the square bore 25, and the sacrificial square bearing 30, a potential pitch, yaw, and roll of the square shaft 15 with respect to the housing 20 can present itself, due to increased slop between the shaft, the square bore, and the square bearing. Inaccuracies in positioning of the square shaft 15 with respect to the housing 20 further tend to increase as the usage of the linear actuator 10 increases, thus leading to an even greater potential of production losses due to missed tolerances on the workpiece.

Thus, square shafts 15 are typically more costly to manufacture and maintain, and can provide undesirable production losses. Round shafts (not shown) are typically less costly, however, the prevention of rotation of a round shaft is typically accomplished by addition of an anti-rotation pin or other mechanism, wherein the anti-rotation pin or mechanism typically adds length to the linear actuator, especially when the linear actuator is fluid-driven, thus requiring some form of a piston and cylinder arrangement. Thus, conventionally, the anti-rotation mechanism is a separate component coupled to an end of a cylindrical piston and cylinder arrangement, wherein the additional length added by the anti-rotation mechanism can be deleterious in certain applications requiring an abbreviated length linear actuator.

Accordingly, a need exists in the art for a reliable, low-maintenance linear actuator that provides accurate positioning of the shaft over a substantially longer period of use than previously achieved. Further, limiting critical tolerances during manufacture of the linear actuator is desired, wherein manufacturing costs can be contained. Such a linear actuator should overcome, or at least minimize, the above-described drawbacks. Preferably, the linear actuator would comprise a simple and economical, yet reliable, device that would accurately position the shaft with a minimum of wear to the linear actuator over its lifetime, while also having less reliance on maintaining numerous critical dimensions during manufacture. Further, the prevention of rotation of the shaft should not significantly add to the overall length of the linear actuator.

SUMMARY

The present invention overcomes the limitations of the prior art by providing a configurable linear actuator that generally prevents a rotation of its shaft while maintaining critical dimensional constraints than conventional linear actuators. Consequently, the following presents a simplified summary of the invention in order to provide a basic understanding of some aspects of the invention. This summary is not an extensive overview of the invention. It is intended to neither identify key or critical elements of the invention nor delineate the scope of the invention. Its purpose is to present some concepts of the invention in a simplified form as a prelude to the more detailed description that is presented later.

The present invention is directed generally toward a linear actuator having a housing, wherein the housing has a bore extending therethrough. A first portion of the bore extends a first distance into the housing from a first end of the housing, and a second portion of the bore extends a second distance into the housing from a second end thereof. The first portion of the bore has a first geometry when viewed from the first end, and the second portion of the bore has a second geometry when viewed from the second end. The second geometry is polygonal with substantially rounded corners, wherein a first interior surface of the second portion of the bore comprises a substantially planar first bearing surface. In one example, the second geometry is generally rectangular with substantially rounded corners.

In accordance with the invention, the linear actuator further comprises a shaft having an axis associated therewith, wherein the shaft has a third geometry when viewed along the axis, and wherein the shaft is in sliding engagement with the first portion of the housing. The first cross section of the first portion of the bore and the third cross section of the shaft, for example, mate with one another, therein providing the sliding engagement therebetween. The first and thirds geometries, for example, are generally circular. A piston member is further operatively coupled to the shaft, wherein the piston member has a fourth geometry when viewed along the axis of the shaft. The fourth geometry is polygonal with substantially rounded corners in a manner similar to the second geometry of the second portion of the bore, wherein the piston member is in sliding engagement with the first interior surface of the second portion of the bore.

The linear actuator of the present invention further comprises an anti-rotation member fixedly coupled to one or more of the piston member and the shaft. The anti-rotation member has a fifth geometry when viewed along the axis of the shaft, wherein the fifth geometry is generally D-shaped, wherein a substantially planar anti-rotation bearing surface is defined between two substantially rounded corners of the anti-rotation member. In a first embodiment, a sliding engagement between is provided in a first orientation of the anti-rotation member, wherein contact between the anti-rotation member and the housing primarily is limited to being between the first bearing surface and the anti-rotation bearing surface. Accordingly, the engagement between the anti-rotation member and the housing generally prevents a rotation of the shaft with respect to the housing.

In accordance with second embodiment of the invention, a third portion of the bore extends a third distance into the housing from the second portion of the bore, wherein the third portion of the bore has sixth geometry when viewed from the second end of the housing. The first interior surface of the first portion of the bore further comprises a substantially planar second bearing surface, wherein the second bearing surface is not co-planar with the first bearing surface. Accordingly, the third portion of the bore further comprises a third interior surface having a substantially planar third bearing surface, wherein the third bearing surface is co-planar with a second bearing surface of the first portion of the bore. A step is further defined between the second portion of the bore and third portion of the bore, wherein the step limits a translation of the piston with respect to the housing when the anti-rotation member is in the first orientation, therein defining a first stroke of the piston. The anti-rotation member is further configured to be positioned in a second orientation within the bore, wherein contact between the anti-rotation member and the housing is limited to a sliding engagement between anti-rotation bearing surface and the second and third bearing surfaces, therein defining a second stroke of the piston.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of a few of the various ways in which the principles of the invention may be employed. Other objects, advantages and novel features of the invention will become apparent from the following detailed description of the invention when considered in conjunction with the drawings.

DETAILED DESCRIPTION

Figure 1:
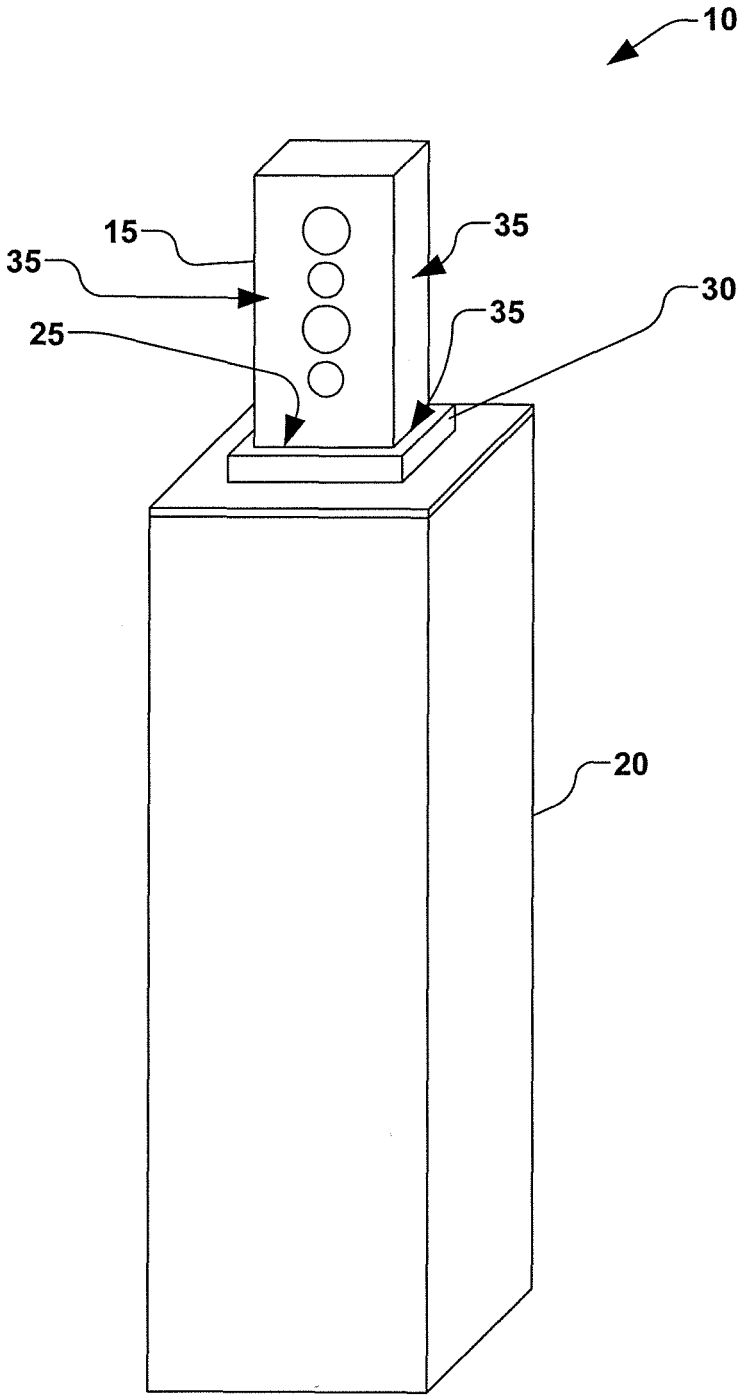
FIG. 1 (Prior Art)
FIG. 1 illustrates a conventional linear actuator having a square anti-rotational shaft.

The present invention will be described with reference to the drawings wherein like reference numerals are used to refer to like elements throughout. It should be understood that the description of these aspects are merely illustrative and that they should not be taken in a limiting sense. In the following description, for purposes of explanation, numerous specific details are set forth in order to provide a thorough understanding of the present invention. It will be evident to one skilled in the art, however, that the present invention may be practiced without these specific details. In other instances, well-known structures and devices are shown in block diagram form in order to facilitate description of the present invention.

Figure 2:
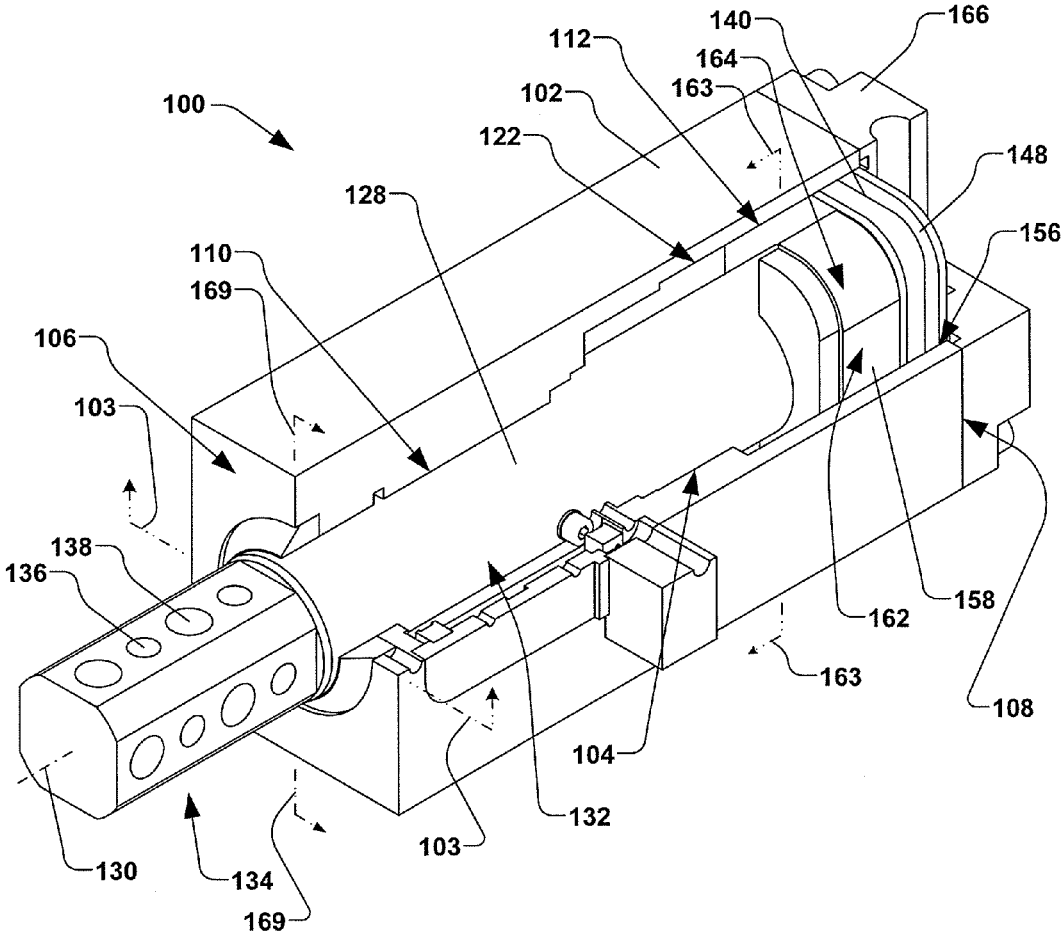
FIG. 2 illustrates a perspective partial cross-sectional view of an exemplary linear actuator according to one aspect of the present invention.
Figure 3:
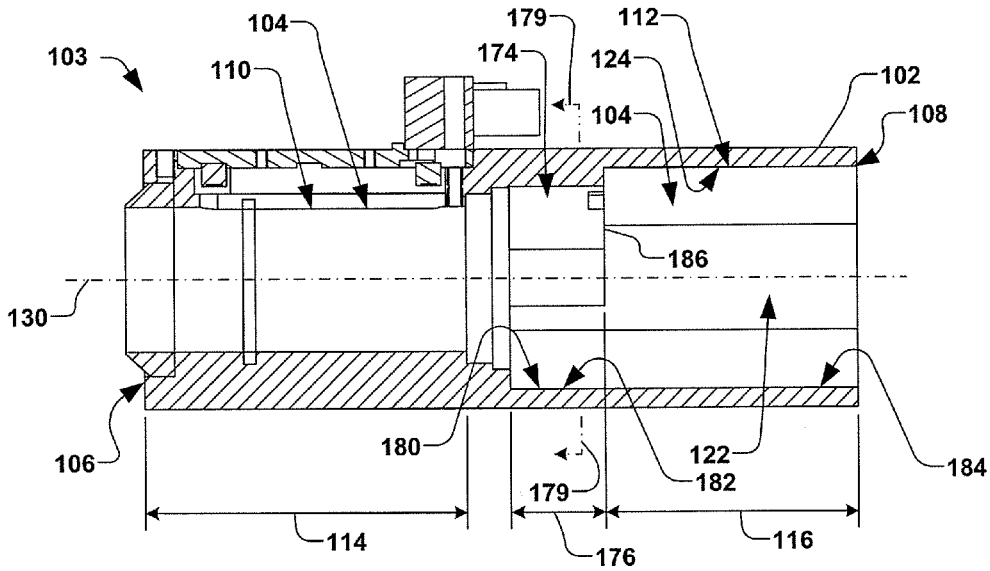
FIG. 3 illustrates a longitudinal cross-section of a housing of the linear actuator of FIG. 2 in accordance with another exemplary aspect of the present invention.

Referring now to the Figures, in accordance with the present invention, FIG. 2 illustrates a perspective partial cross-sectional view of an exemplary linear actuator 100. The linear actuator 100 comprises a housing 102 having a bore 104 extending therethrough, wherein the housing 102 of FIG. 2 is further illustrated in cross-section 103 in FIG. 3. The bore 104, as shown in FIG. 3, for example, extends from a first end 106 of the housing 102 to a second end 108 of the housing, wherein the housing is generally contiguous (e.g., formed from a contiguous block of metal). In the present example, the bore 102 comprises at least a first portion 110 associated with the first end 106 of the housing 102 and a second portion 112 associated with the second end 108 of the housing. The first portion 110 of the bore 104, for example, extends a first distance 114 into the housing 102 from the first end 106 thereof. The second portion 112 of the bore 104 extends a second distance 116 into the housing from the second end 108 of the housing.

Figure 4:
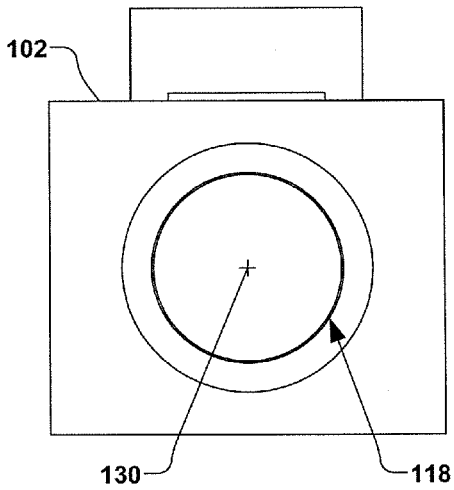
FIG. 4 illustrates a view from a first end of the of the housing of FIG. 3.

In accordance with one aspect of the invention, the first portion 110 of the bore 104 has a first geometry 118 associated therewith, when viewed from the first end 106 of the housing, as illustrated in FIG. 4. In the present example, the first geometry 118 is generally circular. Alternatively, the first geometry 118 can be another rounded shape, such as an oval or ellipse (not shown). In still another alternative, the first geometry 118 can be polygonal, such as a rectangle, square, or other multiple-sided polygon. Accordingly, the first geometry 118 can be any geometrical shape, and all such geometries are contemplated as falling within the scope of the present invention.

Figure 5:
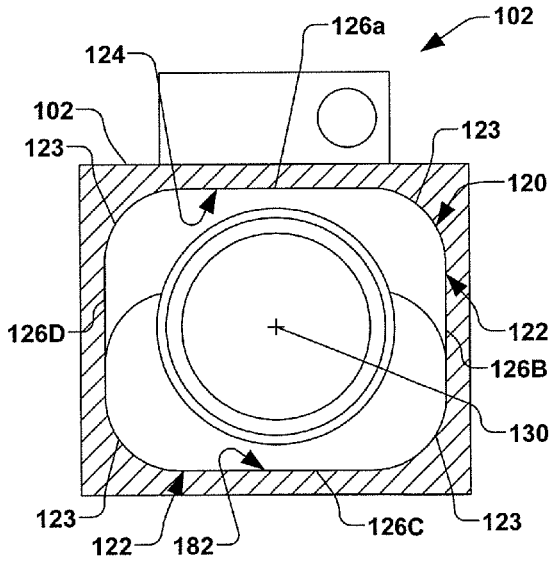
FIG. 5 illustrates a cross-sectional view from a second end of the housing of FIG. 3.

As illustrated in FIG. 5, the second portion 112 of the bore 102 has a second geometry 120 when viewed from the second end 108 of FIGS. 2 and 3, wherein the second geometry is generally polygonal with substantially rounded corners 123, therein defining a first interior surface 122 of the second portion of the bore. In accordance with the invention, the first interior surface 122 of the second portion 112 of the bore 104 further comprises a substantially planar first bearing surface 124, wherein the first bearing surface is generally defined by one side 126 of the second geometry. In the present example, side 126A of the generally rectangular second geometry 120 generally defines the first bearing surface 124. It should be noted that the second geometry 120 can comprise any number of sides 126 (e.g., of equal or unequal lengths) with substantially rounded corners 128 between the sides, as will be further discussed infra.

Figure 6:
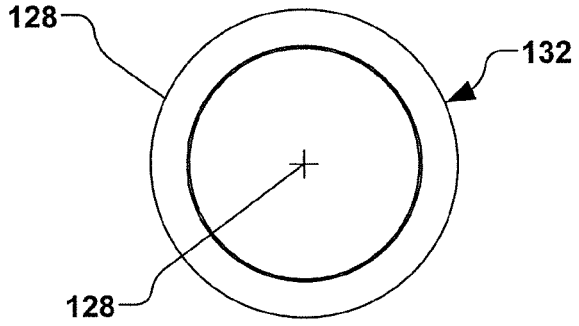
FIG. 6 illustrates a view from an end of a shaft of the linear actuator according to the yet another aspect of the present invention.

Referring again to FIG. 2, the linear actuator 100 of the present invention further comprises a shaft 128, wherein the shaft is in sliding engagement with at least the first portion 110 of the bore 104. The shaft 128 has an axis 130 associated therewith, wherein, in general, the shaft is configured to travel along the axis. The shaft 128 further has a third geometry 132 when viewed from an end 134 thereof along the axis, as illustrated in FIG. 6. The shaft 128 of FIG. 2, for example, is configured to extend and retract through the first end 106 of the housing 102 along the axis 130. In one example, the first geometry 118 of the first portion 110 of the bore 104 and the third geometry 132 of the shaft 128 are generally round when viewed from the first end 108 of the housing 102. For example, the shaft 128 and the first portion 110 of the bore 104 are generally circular in cross-section (ie., the first geometry 118 of the bore and the third geometry 132 of the shaft are generally circular). It should be noted, however, that the first and third geometries 118 and 132 can comprise any round geometry, such as an ovular geometry or other rounded geometry, and all such geometries are contemplated as falling within the scope of the present invention. In another example, the shaft 128 and first portion 110 of the bore 104 are generally polygonal in cross-section when viewed from the first end 106 of the housing 102 (e.g., along the axis 130). For example, the first and third geometries 118 and 132 can be generally rectangular or square in cross-section, however, any polygonal geometry having any number of equal or unequal sides is also contemplated as falling within the scope of the present invention, wherein the shaft 128 slidingly engages the first portion 110 of the bore 104.

As further illustrated in FIG. 2, the end 134 of the shaft 128, for example, is adapted to connect to one or more end effectors (not shown), such as a clamping arm or positioning pin, as will be understood by one of ordinary skill in the art. For example, the end 134 may comprise one or more holes 136 (e.g., threaded or thru-holes), machined flats 138 or other features that generally permit the coupling of the one or more end effectors thereto.

According to another exemplary aspect of the invention, the linear actuator 100 further comprises a piston member 140 operatively coupled to the shaft 128. The piston member 140, in one example, is fixedly coupled to the shaft 128, wherein the piston member and shaft are generally prevented from rotating with respect to one another. Alternatively, the piston member 140 can be rotatably coupled to the shaft 128, wherein the piston member and shaft around operable to rotate with respect to one another about the axis 130.

Figure 7:
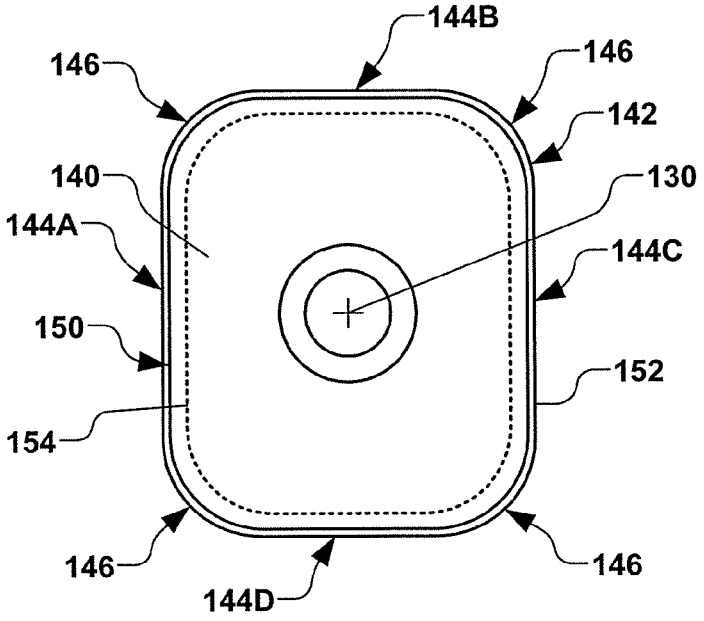
FIG. 7 illustrates view of an exemplary piston member according to another exemplary aspect of the invention.

As illustrated in FIG. 7, the exemplary piston member 140 has a fourth geometry 142 when viewed along the axis 130 of the shaft, wherein the fourth geometry, for example, is polygonal with substantially rounded corners. The piston member 140 is thus configured to be in mating sliding engagement with the first interior surface 122 of the second portion 112 of the bore 104 of FIG. 3. In one example, the fourth geometry 142 is rectangular having four edges 144 with substantially rounded corners 146 therebetween. In another example, the fourth geometry 142 is square with similarly substantially rounded corners. The fourth geometry 142 of the piston member 140 is thus configured to slidingly mate with the first interior surface 122 of the second portion 112 of the bore 104. It should be noted that the respective second and fourth geometries 120 and 142 may have any number of equal or unequal sides 126 and edges 144 with rounded corners 146 therebetween, so long as the second and fourth cross sections share a similar geometry such that the piston member 140 slidingly engages the first interior surface 122. For example, the second and fourth geometries 120 and 142 may each comprise three-sides, five-sides, six-sides, etc., all with substantially rounded corners therebetween.

The piston member 140, as illustrated in FIG. 7, for example, further comprises a sealing member 148 operatively coupled to a periphery 150 of the piston member. For example, the sealing member 148 comprises a generally resilient o-ring 152 positioned in an o-ring groove 154 about the periphery 150 of the piston member. Thus, as illustrated in FIG. 2, an interface 156 between the sealing member 148 and the first interior surface 122 of the bore 104 thus generally defines a sliding seal between the piston member 140 and the housing 102. The sealing member 148, for example, is configured to wrap around the generally rounded corners of the periphery 150 of the piston member, thus providing an adequate sealing interface between the piston member and the housing 102. Thus, the substantially rounded corners 146 of the piston member 140 generally permit the sealing member 148 to adequately seal the interface 156, whereas a sharp corner (not shown) would typically not provide such an adequate seal.

Figure 8:
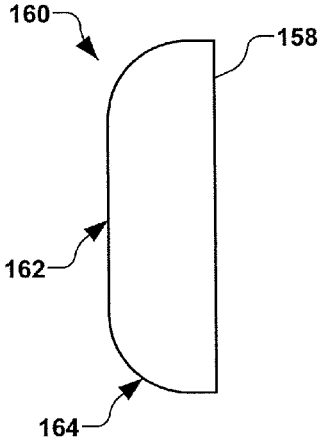
FIG. 8 illustrates a cross-sectional view of an exemplary anti-rotation member in accordance with still another aspect of the present invention.
Figure 9:
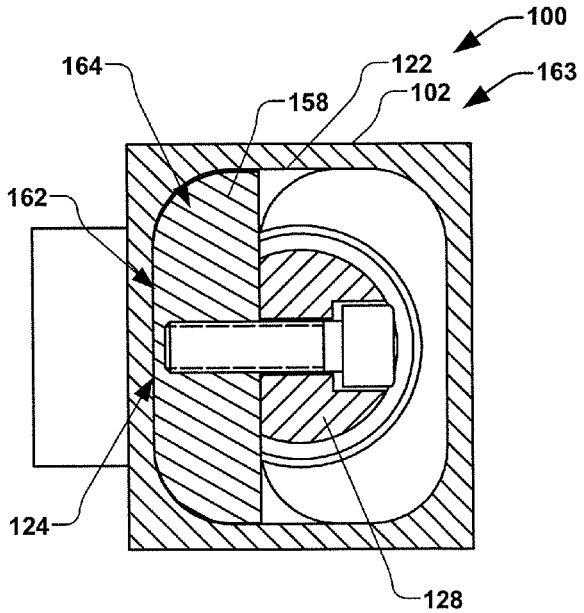
FIG. 9 illustrates a cross-sectional view of the linear actuator from a second end in accordance with a further aspect of the present invention.
Figure 10:
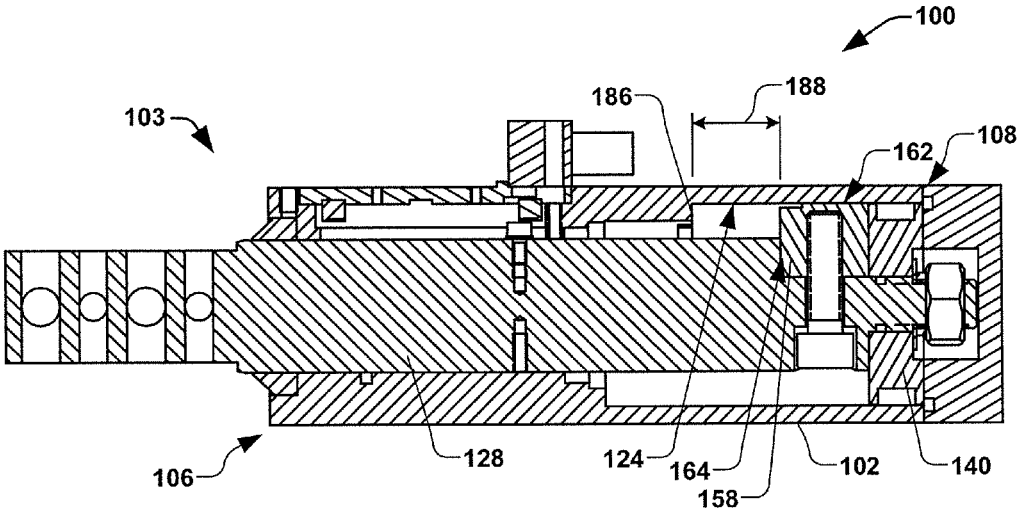
FIG. 10 illustrates a cross-sectional view of the linear actuator of FIG. 2 with the anti-rotation member in a first orientation in accordance with another aspect of the invention.

In accordance with the invention, the linear actuator 100 of FIG. 2 further comprises an anti-rotation member 158 fixedly coupled to one or more of the piston member 140 and the shaft 128. The anti-rotation member 158, when viewed along the axis 130 of the shaft 128, further has a fifth geometry 160 associated therewith, as illustrated in FIG. 8. The fifth geometry 160 is generally D-shaped, wherein a substantially planar anti-rotation bearing surface 162 is defined between two substantially rounded corners 164 of the anti-rotation member 158. Accordingly, when viewed from cross-section 163 of the linear actuator 100 of FIG. 2, as illustrated in FIG. 9, contact between the anti-rotation member 158 and the housing 102 primarily exists along a sliding engagement between the first bearing surface 124 and the anti-rotation bearing surface 162 in a first orientation 164 of the anti-rotation member with respect to the housing. FIG. 10 further illustrates the cross-section 103 of the linear actuator 100 of FIG. 2, wherein the anti-rotation member 158 is in the first orientation 164, and wherein sliding contact between the anti-rotation member and the housing 102 primarily exists between the first bearing surface 124 of the housing and the anti-rotation bearing surface 162 of the anti-rotation member.

Accordingly, the shaft 128 is generally prevented from a rotation about the axis 130 of FIG. 2 with respect to the housing 102. The anti-rotation member 158, for example, is machined such that the two substantially rounded corners 164 of FIG. 8 do not generally contact the first interior surface 122 of the housing of FIGS. 2 and 9, wherein most, if not all, of the contact between the anti-rotation member 158 and the housing occurs at the interface between the anti-rotation bearing surface 162 and the first bearing surface 124 (when the anti-rotation member is in the first orientation 164 with respect to the housing 102). Thus, higher degrees of dimensional precision during manufacture primarily exist along the first bearing surface 124 of the housing and the anti-rotation bearing surface 162 of the anti-rotation member 158, while machining accuracies of the remainder of the first interior surface 122 and anti-rotation member 158 may be relaxed. Accordingly, a significant cost savings can be realized in the machining of the linear actuator 100 of the present invention.

Another clear advantage of the present invention is that the first bearing surface 124, such as that illustrated in FIG. 10, also functions as a portion of the interface 156 between the piston member 140 and the housing 104. By providing the first bearing surface 124 as a part of the first interior surface 122 (along which the piston member 140 translates), the anti-rotation member 158 shares the space needed for the translation of the piston member 140 within the housing 104. Thus, the overall length of the linear actuator 100 can be minimized in a way that has not been seen heretofore.

Figure 11:
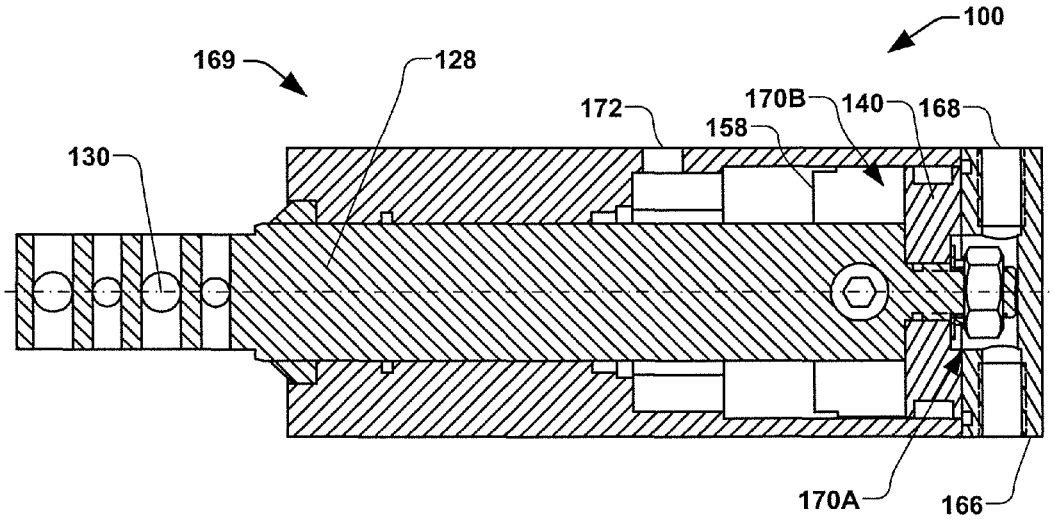
FIG. 11 illustrates another cross-sectional view of the linear actuator of FIG. 2 according to another exemplary aspect of the invention.

As illustrated in FIG. 2, the linear actuator 100 further comprises an end cap 166 operatively coupled to the housing 102, wherein the end cap generally encloses second portion 112 of the bore 104. The end cap 166 of the linear actuator 100 may be further configured with one or more first ports 168, as illustrated in cross-section 169 shown in FIG. 11, wherein the one or more ports provide selective fluid communication between a pressurized fluid source (not shown) and a first side 170A of the piston member 140. Accordingly, the housing 102 further comprises one or more second ports 172 in fluid communication with a second side 170B of the piston member 140. Thus, the pressurized fluid source can selectively translate the piston member 140, anti-rotation member 158, and shaft 128 along the axis 130, based on which of the first and second ports 168 and 172 are presented with pressurized fluid (e.g., a liquid or gas).

Figure 12:
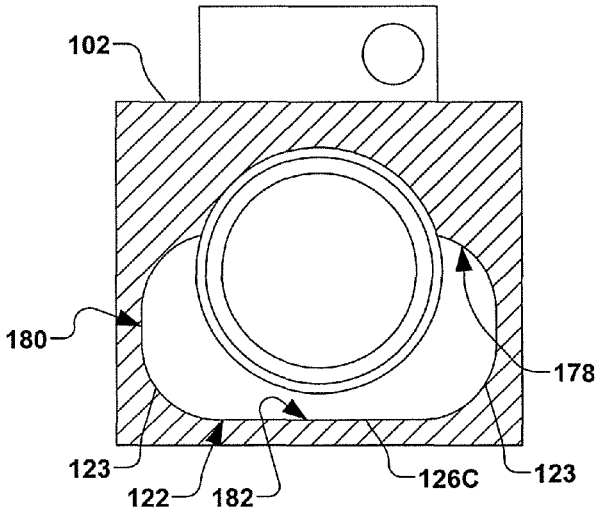
FIG. 12 illustrates another cross-sectional view of the housing of FIG. 2 in accordance with another aspect of the invention.

In accordance with another embodiment of the invention, referring again to FIG. 3, the bore 104 further comprises a third portion 174, wherein the third portion of the bore extends a third distance 176 into the housing 102 from the second portion 112 of the bore. The third portion 174 of the bore 104 has sixth geometry 178 when viewed from the second end 108 of the housing 102, as illustrated in cross-section 179 in FIG. 12. The third portion 174 of the bore 104 further defines a second interior surface 180 of the bore, wherein the second interior surface comprises a substantially planar second bearing surface 182. The second bearing surface 182 is further co-planar with a third bearing surface 184 of the first interior surface 122. Furthermore, the third portion 174 of the bore 104 of FIG. 3 further defines a step 186 between the second portion 112 and the third portion of the bore, wherein the step generally limits a translation of the piston member 140 with respect to the housing 102 when the anti-rotation member 158 is in the first orientation 164 of FIGS. 2, 9 and 10. Accordingly, as illustrated in FIG. 10, when the anti-rotation member 158 is in the first orientation 164, a first stroke 188 (associated with the first distance 116 of FIG. 3) of the piston member 140 and shaft 128 is generally defined. For example, the anti-rotation member 158 utilizes the step 186 to limit the first stroke 188 when the piston member 140 travels from the second end 108 toward the first end 106 of the housing 102.

Figure 13:
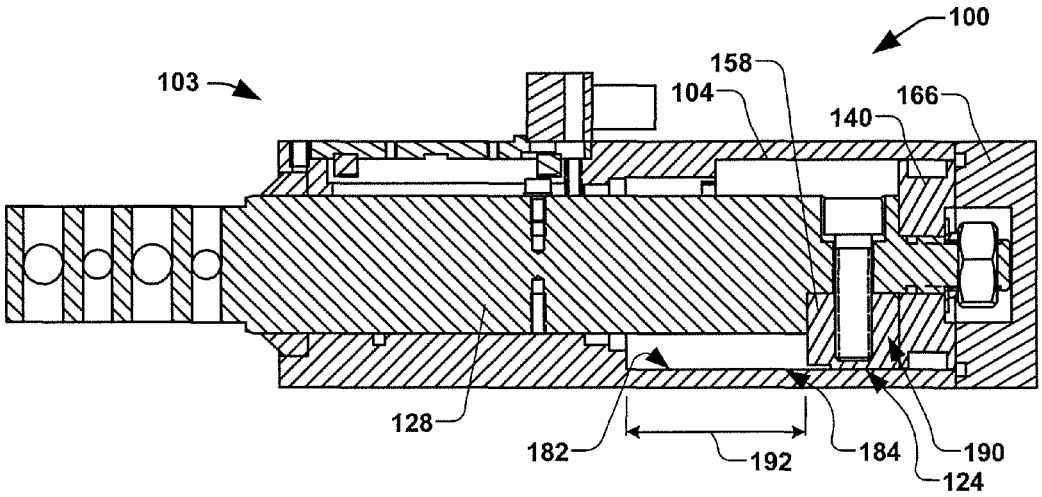
FIG. 13 illustrates a cross-sectional view of the linear actuator of FIG. 2 with the anti-rotation member in second first orientation in accordance with still another aspect of the invention.
Figure 14:
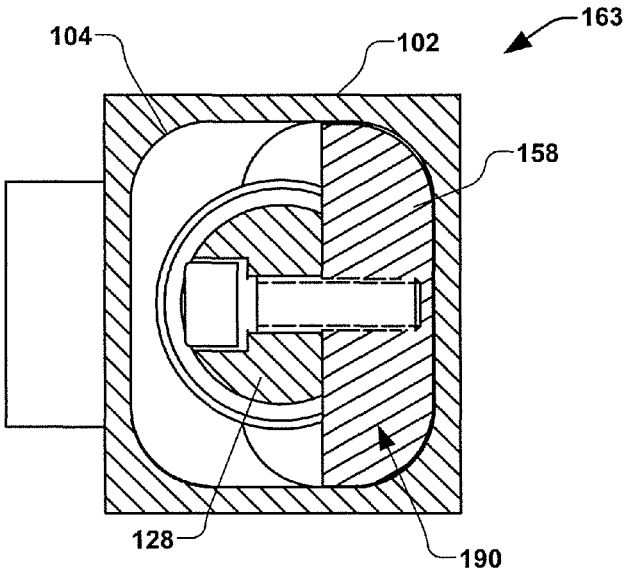
FIG. 14 illustrates another cross-sectional view of the linear actuator from the second end when the anti-rotation member is in the second orientation in accordance with still a further aspect of the present invention.

In another exemplary aspect of the invention, the anti-rotation member 158 is further configured to be positioned in a second orientation 190 with respect to the housing 102 within the bore 104 of FIG. 2, as illustrated in FIGS. 13-14. FIG. 13, for example, represents cross-section 103 of the linear actuator 100 of FIG. 2 when the anti-rotation member 158 is positioned in the second orientation 190, while FIG. 14 views the linear actuator from cross section 163 of FIG. 2 when the anti-rotation member is positioned in the second orientation. Accordingly, contact between the anti-rotation member 158 and the housing 102 is primarily present along a sliding engagement between the second bearing surface 182 and third bearing surface 184 and the anti-rotation bearing surface 162 when the anti-rotation member is in the second orientation 190 with respect to the housing. Thus, a second stroke 192 of the piston member 140 is generally defined, as illustrated in FIG. 13, wherein the second stroke, in the present example, is longer than the first stroke 188 of FIG. 10.

The present invention further contemplates that additional strokes (not shown) can be achieved in a similar manner by utilizing another side (e.g., side 126D and/or side 126B of FIG. 5) as an additional housing bearing surface, wherein the respective side extends further into the housing 102 from the third portion 174 of the bore 104. Further, in such an instance, the second geometry 120 and fourth geometry 142, for example, may alternatively be generally triangular with substantially rounded corners; however, the present disclosure contemplates various other configurations and geometries, as well.

In accordance with still another exemplary aspect of the invention, one or more of the first bearing surface 124, second bearing surface 182, third bearing surface 184, and anti-rotation bearing surface 162 are comprised of a hardened material, wherein minimal wear to the respective surfaces can be achieved. For example, the first bearing surface 124, second bearing surface 182, third bearing surface 184, and anti-rotation bearing surface 162 are comprised of one or more materials having a hardness of approximately HRC 65 or greater, wherein the sliding engagement between the anti-rotation member 158 and the housing 102 can be defined as a hard-on-hard bearing surface. Such a hard-on-hard bearing surface generally provides minimal wear to both the shaft 128 and housing 102, wherein the minimal wear can be achieved with a small amount of lubrication.

Although the invention has been shown and described with respect to certain aspects, equivalent alterations and modifications will occur to others skilled in the art upon the reading and understanding of this specification and the annexed drawings. In particular regard to the various functions performed by the above described components (systems, devices, assemblies, etc.), the terms used to describe such components are intended to correspond, unless otherwise indicated, to any component which performs the specified function of the described component (i.e., that is functionally equivalent), even though not structurally equivalent to the disclosed structure that performs the function in the herein illustrated exemplary aspects of the invention. In addition, while a particular feature of the invention may have been disclosed with respect to only one of several aspects, such feature may be combined with one or more other features of the other aspects as may be desired and advantageous for any given or particular application. Furthermore, to the extent that the term "includes" is used in either the detailed description or the claims, such term is intended to be inclusive in a manner similar to the term "comprising."

What is claimed:

1. A linear actuator, comprising:

a housing having a bore extending therethrough, wherein a first portion of the bore extends a first distance into the housing from a first end thereof, and wherein a second portion of the bore extends a second distance into the housing from a second end thereof, wherein the first portion has a first geometry when viewed from the first end, and wherein the second portion has a second geometry when viewed from the second end, wherein the second geometry is polygonal with substantially rounded corners, and wherein a first interior surface of the second portion of the bore comprises a substantially planar first bearing surface;

a shaft having an axis associated therewith, wherein the shaft has a third geometry when viewed along the axis, and wherein the shaft is in sliding engagement with the first portion of the housing;

a piston member operatively coupled to the shaft, the piston member having a fourth geometry when viewed along the axis of the shaft, wherein the fourth geometry is polygonal with substantially rounded corners, and wherein the piston member is in sliding engagement with the first interior surface of the second portion of the bore;

an anti-rotation member fixedly coupled to one or more of the piston member and the shaft, wherein the anti-rotation member has a fifth geometry when viewed along the axis of the shaft, wherein the fifth geometry is generally D-shaped, wherein a substantially planar anti-rotation bearing surface is defined between two substantially rounded corners of the anti-rotation member, and wherein contact between the anti-rotation member and the housing primarily exists along a sliding engagement between the first bearing surface and the anti-rotation bearing surface in a first orientation of the anti-rotation member with respect to the housing, therein generally preventing a rotation of the shaft with respect to the housing.

2. The linear actuator of claim 1, wherein the first and third geometries are a generally circular.

3. The linear actuator of claim 1, wherein the second and fourth geometries are rectangular with substantially rounded corners.

4. The linear actuator of claim 3, wherein the second and fourth geometries are square with substantially rounded corners.

5. The linear actuator of claim 1, wherein the piston member comprises a sealing member operatively coupled to a perimeter of the piston member, wherein an interface between the sealing member and the first interior surface generally defines a sliding seal between the piston member and the housing.

6. The linear actuator of claim 5, wherein the sealing member comprises a generally resilient o-ring.

7. The linear actuator of claim 1, further comprising an end cap operatively coupled to the housing, wherein the end cap generally encloses the second portion of the bore.

8. The linear actuator of claim 7, wherein the end cap comprises a first port in fluid communication with a first side of the piston member, and wherein the housing comprises a second port in fluid communication with a second side of the piston member.

9. The linear actuator of claim 1, wherein a third portion of the bore extends a third distance into the housing from the second portion of the bore, wherein a second interior surface of the third portion of the bore comprises a substantially planar second bearing surface, wherein the second bearing surface is co-planar with a third bearing surface of the first interior surface, and wherein a step is defined between the second portion and third portion of the bore, wherein the step limits a translation of the piston with respect to the housing when the anti-rotation member is in the first orientation, therein defining a first stroke of the piston, and wherein the anti-rotation member is further configured to be positioned in a second orientation with respect to the housing, wherein contact between the anti-rotation member and the housing is present along a sliding engagement between the second bearing surface, third bearing surface, and the anti-rotation bearing surface in the second orientation of the anti-rotation member, therein defining a second stroke of the piston.

10. The linear actuator of claim 9, wherein the second orientation of the anti-rotation member differs from the first orientation by 180 degrees about the axis of the shaft.

11. The linear actuator of claim 1, wherein the housing is comprised of a contiguous block of metal.

12. A linear actuator, comprising:

a housing having a bore extending therethrough, wherein a first portion of the bore extends a first distance into the housing from a first end thereof, and wherein a second portion of the bore extends a second distance into the housing from a second end thereof, wherein the first portion has a round geometry when viewed from the first end, and wherein the second portion has a rectangular geometry with substantially rounded corners when viewed from the second end, and wherein an interior surface of the second portion of the bore comprises a substantially planar first bearing surface and a substantially planar second bearing surface;

a shaft having an axis associated therewith, wherein the shaft is in sliding engagement with the first portion of the housing;

a piston member operatively coupled to the shaft, the piston member having a rectangular geometry with substantially rounded corners when viewed along the axis of the shaft, and wherein the piston member is in sliding engagement with the first interior surface of the second portion of the bore; and an anti-rotation member fixedly coupled to one or more of the piston member and the shaft, wherein the anti-rotation member has a substantially planar anti-rotation bearing surface, and wherein contact between the anti-rotation member and the housing is limited to a sliding engagement between the first bearing surface and the anti-rotation bearing surface in a first orientation of the anti-rotation member with respect to the housing, and to a sliding engagement between the second bearing surface and the anti-rotation bearing surface in a second orientation of the anti-rotation member with respect to the housing, therein generally respectively preventing a rotation of the shaft with respect to the housing in either of the first orientation or second orientation.

13. The linear actuator of claim 12, wherein the anti-rotation member has a generally D-shaped geometry when viewed along the axis of the shaft, wherein the anti-rotation bearing surface is defined between two substantially rounded corners of the anti-rotation member.

14. The linear actuator of claim 12, wherein the piston member comprises a sealing member operatively coupled to a perimeter of the piston member, wherein an interface between the sealing member and the first interior surface generally defines a sliding seal between the piston member and the housing.

15. The linear actuator of claim 14, wherein the sealing member comprises a generally resilient o-ring.

16. A linear actuator, comprising:

a housing comprising having a bore therethrough, wherein the bore comprises:

a first portion extending a first distance into the housing from a first end thereof, the first portion having a first geometrical profile;

a second portion extending a second distance into the housing from a second end thereof, the second portion having a second geometrical profile; and a third portion extending a third distance into the housing from the second portion, the third portion having third geometrical profile;

a shaft having an axis associated therewith, wherein the shaft is in sliding engagement with the first portion of the bore;

a piston member operatively coupled to the shaft, wherein the piston member is in sliding engagement with the second portion of the bore; and an anti-rotation member fixedly coupled to one or more of the piston member and the shaft, wherein the anti-rotation member has a substantially planar anti-rotation bearing surface, and wherein contact between the anti-rotation member and the housing is limited to a sliding engagement between the second portion of the bore and the anti-rotation bearing surface in a first orientation of the anti-rotation member, and to a sliding engagement between the second portion and third portion of the bore and the anti-rotation bearing surface in a second orientation of the anti-rotation member, therein generally respectively preventing a rotation of the shaft with respect to the housing in either of the first orientation or second orientation, and wherein the first orientation defines a first stroke of the shaft, and wherein the second orientation defines a second stroke of the shaft, wherein the second stroke is longer than the first stroke.

17. The linear actuator of claim 16, wherein the first geometrical profile is circular when viewed from the first end, wherein the second geometrical profile is rectangular with substantially rounded corners when viewed from the second end, and wherein the third geometrical profile is substantially D-shaped.

18. The linear actuator of claim 17, wherein the third geometrical profile is generally defined by a portion of the second geometrical profile.

19. A linear actuator, comprising:

a housing comprising bore therethrough, the bore having a generally circular geometry at a first end and a polygonal geometry with substantially rounded corners at a second end, and wherein at least one substantially planar housing bearing surfaces are defined by the polygonal geometry;

an end cap operatively coupled to the housing, wherein the end cap generally encloses the second end of the bore; and a shaft having first, second, and third geometries associated therewith when viewed along an axis thereof, the first geometry be a generally circular and in sliding engagement with the circular geometry of the bore, the second geometry being a generally D-shaped, wherein a substantially planar anti-rotation bearing surface is defined between two substantially rounded corners of the generally D-shaped geometry, and wherein the anti-rotation bearing surface is in sliding engagement with one of the at least one housing bearing surfaces based on an orientation of the shaft with respect to the housing, and wherein the third geometry is polygonal with substantially rounded corners, wherein the third geometry is in mating sliding engagement with the polygonal geometry of the bore.

20. A linear actuator, comprising:

a housing having a bore extending therethrough, wherein the bore has a generally circular geometry when viewed from a first end of the housing having a first interior surface associated therewith, and wherein the bore has a generally polygonal geometry when viewed from a second end of the housing having second interior surface associated therewith, wherein the second interior surface comprises a housing bearing surface that is substantially planar;

an elongate shaft having a generally circular geometry when viewed along an axis thereof, the elongate shaft having a first exterior surface in sliding engagement with the first interior surface of the housing;

a piston member operatively coupled to the shaft, the piston member having a polygonal geometry when viewed along the axis of the shaft and having a second exterior surface associated therewith, wherein the polygonal cross section of the piston member generally conforms to the polygonal cross section of the bore;

a sealing member operatively coupled to a perimeter of the piston member, wherein an interface between the sealing member and the second interior surface of the bore generally defines a sliding seal between the piston member and the housing; and an anti-rotation member fixedly coupled to one or more of the piston member and the shaft, wherein the anti-rotation member has a generally D-shaped geometry when viewed along the axis of the shaft, wherein an anti-rotation bearing surface is defined between two substantially rounded corners of the generally D-shaped geometry of the anti-rotation member, and wherein the anti-rotation bearing surface is substantially planar, wherein contact between the anti-rotation member and the housing is only permitted along a sliding engagement between the housing bearing surface and the anti-rotation bearing surface based on an orientation of the anti-rotation member within the housing, therein generally preventing a rotation of the shaft with respect to the housing.

21. The linear actuator of claim 20, further comprising an end cap operatively coupled to the second end of the housing, wherein the end cap generally encloses the bore at the second end of the housing.

22. The linear actuator of claim 20, wherein corners of the polygonal geometries of the bore and the piston member are substantially rounded.

23. The linear actuator of claim 22, wherein the polygonal geometries of the bore and piston are rectangular with substantially rounded corners.

* * * * *